US006992244B2

(12) United States Patent
Paul et al.

(10) Patent No.: US 6,992,244 B2
(45) Date of Patent: Jan. 31, 2006

(54) HOLD DOWN CLAMP

(75) Inventors: Michael Paul, New Britain, CT (US); Robert Gatzan, Newington, CT (US)

(73) Assignee: Drum Workshop, Inc., Oxnard, CA (US)

( * ) Notice: Subject to any disclaimer, the term of this patent is extended or adjusted under 35 U.S.C. 154(b) by 54 days.

(21) Appl. No.: 10/755,912

(22) Filed: Jan. 13, 2004

(65) Prior Publication Data

US 2005/0150354 A1 Jul. 14, 2005

(51) Int. Cl.
*G10D 13/02* (2006.01)

(52) U.S. Cl. ..... 84/422.1; 84/422.2; 84/422.3

(58) Field of Classification Search ..... 84/422.1, 84/422.2, 422.3
See application file for complete search history.

(56) References Cited

U.S. PATENT DOCUMENTS

| | | | | |
|---|---|---|---|---|
| 3,426,640 | A | 2/1969 | Slingerland, Jr. | |
| 5,565,637 | A * | 10/1996 | Shigenaga | 84/422.1 |
| 5,726,370 | A | 3/1998 | Yanagisawa | |
| 6,011,208 | A | 1/2000 | Hoshino | |
| 6,166,312 | A | 12/2000 | Brewster et al. | |
| 2002/0194981 | A1 * | 12/2002 | Hsieh | 84/422.1 |

* cited by examiner

*Primary Examiner*—Kimberly Lockett
(74) *Attorney, Agent, or Firm*—William W. Haefliger

(57) ABSTRACT

A base drum rim clamp device comprising in combination, a base, a wedging device to exert clamping force that device carried by the base, means to displace said device to move a surface or surfaces of the device relatively toward one side of a base drum rim, and a clamp part to which clamping force is transmitted at the opposite side of the drum rim.

11 Claims, 5 Drawing Sheets

HOLD DOWN CLAMP

BACKGROUND OF THE INVENTION

This invention relates generally to clamping of drum rims, and more particularly to an improved, easily adjustable, clamping device, positively connectible to a drum rim so as not to inadvertently loosen or disconnect.

There is need for improvements in drum associated clamping devices of rugged construction, to provide the advantages as referred to, as well as other advantages, as will be seen.

SUMMARY OF THE INVENTION

It is a major object of the invention to provide an improved drum rim clamping apparatus, as may be incorporated on a pedal unit that drives a drum beater. Basically, the invention is embodied in a combination that includes:

a) a base b) a wedging device to exert clamping force, that device carried by the base, c) means to displace said device to move a surface or surfaces of the device relatively toward one side of a base drum rim, and d) a clamp part to which clamping force is transmitted at the opposite side of the drum rim.

As will be seen, that device may advantageously include two wedges carried for adjustable relative movement toward one another, or away from one another. The wedges easily support drum rims of different curvature, as at spaced surface locations on the wedges. The wedges typically have substantially flat surfaces that extend in tangential contact relation with the arcuate rim, for stable support of the rim.

It is another object of the invention to provide for carriage of both wedges for simultaneous relative movement toward one another, or away from one another.

Such movement may be effected by a displacer having screw thread operative connection to the device. The displacer may advantageously comprise an adjustably rotatable displacer having screw thread operative connection to the wedges. In this regard, the displacer may have differential screw thread operative connection to the wedges, whereby, as the displacer is rotated in one rotary direction the wedges are relatively displaced toward one another, and as the displacer is rotated in the opposite rotary direction, the wedges are relatively displaced away from one another. Also, the wedges may have aligned bores which are threaded to receive differential threading on the displacer, whereby both wedges are moved, to clamp the drum rim in response to simple rotation of the displacer in one direction, and with mechanical advantage. The threaded bores and the displacer threading define worm gearing, which prevents unclamping of the rim during drum beating.

A further object is to provide a guide channel on the base, extending in generally perpendicular relation to a base plate of a pedal unit carrying the channel, that unit including a pedal pivotally carried by the base plate, a drum beater pivotally carried by the base plate, and a drive connected between the pedal and the drum beater. The clamp unit of the invention is also useful in other environments, as will be seen.

These and other objects and advantages of the invention, as well as the details of an illustrative embodiment, will be more fully understood from the following specification and drawings, in which:

DRAWING DESCRIPTION

Fig. is a side elevation of a pedal unit carrying base drum rim clamping structure;

DETAILED DESCRIPTION

Figure 1:
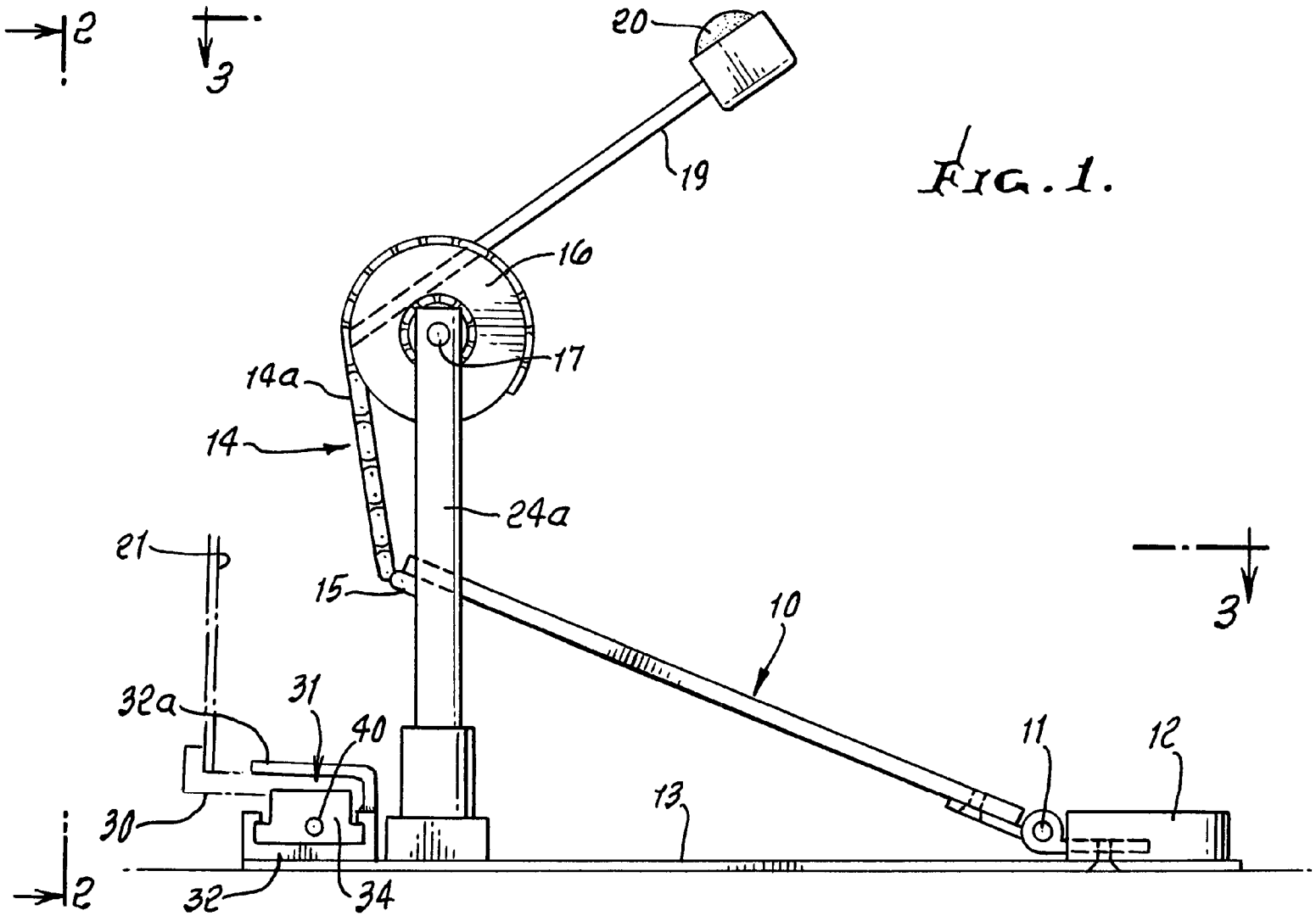

In FIG. 1, a pedal 10 is pivoted at 11 to a heel support 12, attached to base plate 13. A flexible coupling, such as a chain 14 is connected at 15 to the forward end of the pedal 10, and extends upwardly at 14*a* to mesh with and/or wrap on a sprocket or drum 16. The latter is fixedly mounted to an axle 17, whereby, as the pedal is pushed down by the user's shoe or foot, the sprocket and axle are rotated; the beater 19 then rotates forwardly so that head 20 strikes the bass drum surface or head indicated at 21.

Yieldable means, such as tension spring 22 is operatively connected between a rotor 23 on the axle, and the frame, such as the lower end of pedestal 24, to yieldably resist axle rotation, and return the beater to FIG. 1 position. Rotor 23 defines an effective crank arm 23*a* to which a spring support 25 is connected. A spring tension adjustment means is shown at 27. Two pedestals 24 and 24*a* support the axle 17, for rotation, and are carried by the base plate 13.

In accordance with an important aspect of the invention, a clamp device, for attachment to a base drum rim 30, is indicated generally at 31. That device preferably includes:

a) a base 32, b) a wedging device, such as two wedges 33 and 34 to exert clamping force, the device or wedges carried by the base, c) means to displace that device to move a device surface or surfaces relatively toward one side of base drum rim 30, and d) a clamp part 32*a* to which clamping force is transmitted at the opposite side of the drum rim.

Figure 2:
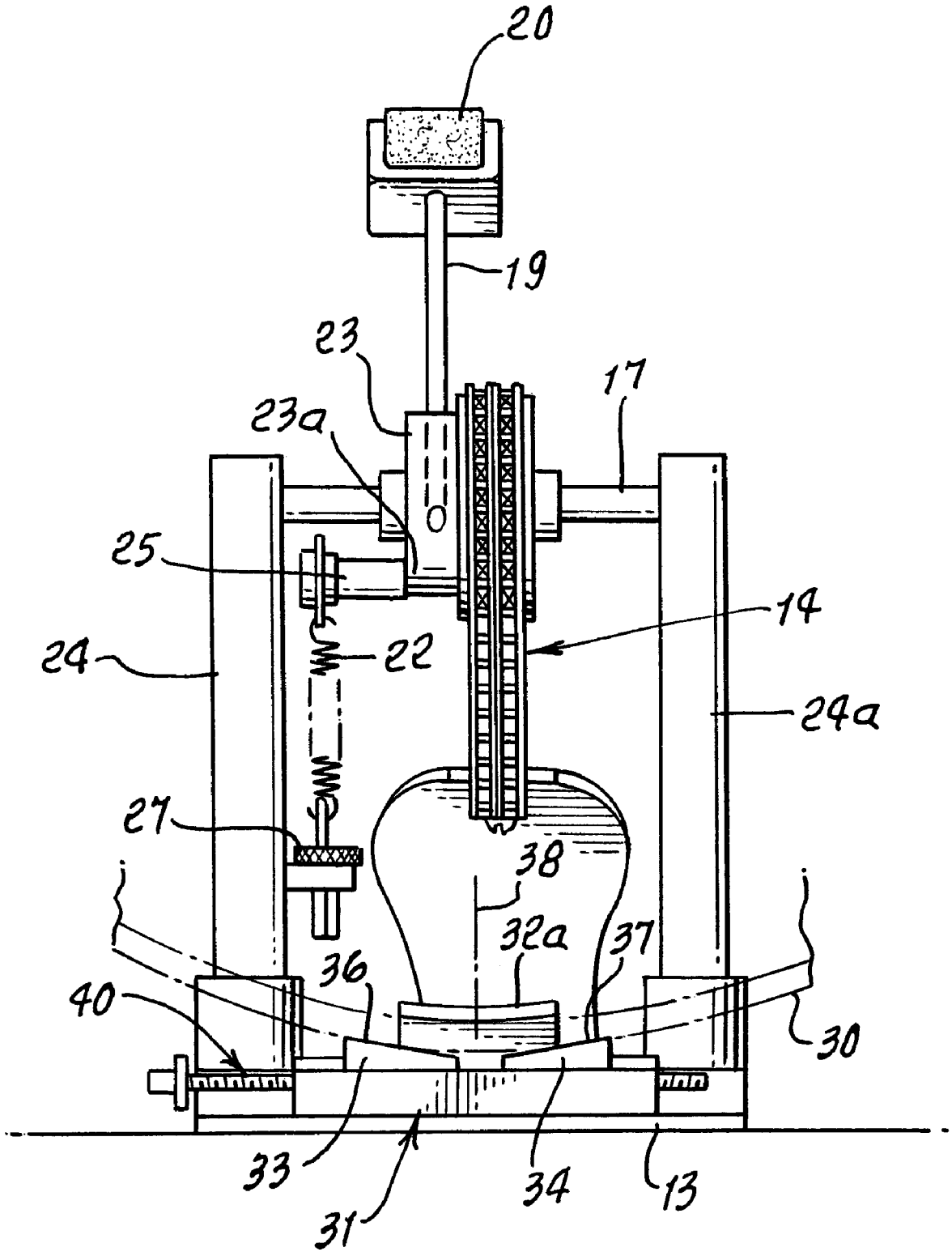
FIG. 2 is a frontal elevation taken on lines 2—2 of FIG. 1.
Figure 3:
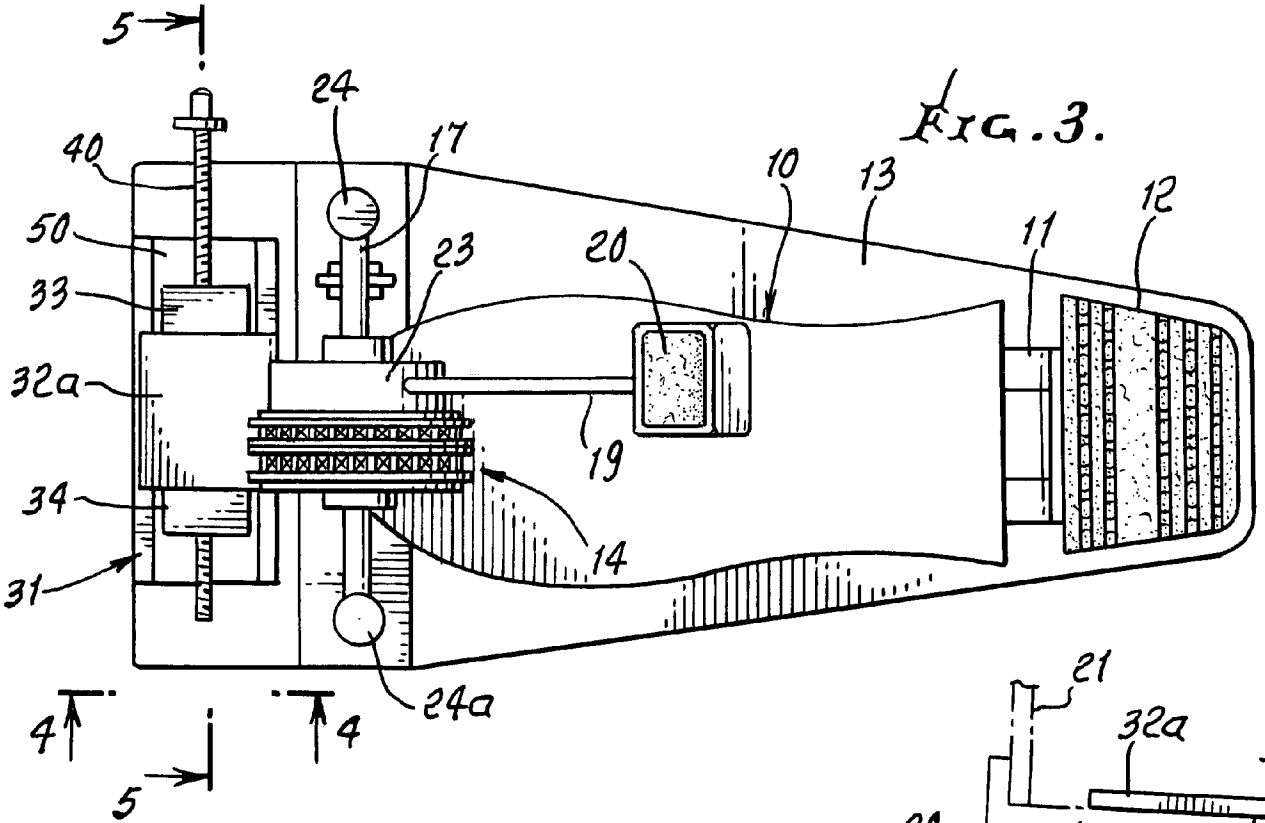
FIG. 3 is a top plan view taken on lines 3—3 of FIG. 1.

The two wedges are carried for adjustable relative movement, of at least one wedge and preferably both wedges, toward one another, or away from one another. Typically, the two wedges are slidably carried by the base 32 for simultaneous relative movement toward one another, or away from one another. In this regard, the drum rim, which may be metallic, is arcuate, for example circular, and stably supported on wedge oppositely angled surfaces, at spaced contact locations. For example such locations 36 and 37 are at approximately equal spacings from a vertical plane 38 normal to the plane of FIG. 2. The wedges are also typically metallic, and their angled surfaces are flat and extend in tangential contact with the outer side of the drum rim, which they support, enabling sliding of the wedges under the rim.

Means is provided to displace the device 31 to move a surface or surfaces of the device relatively toward one side (typically the outer side) of the drum rim; and a clamp part is provided to which clamping force exerted by device 31 is transmitted, via the rim, at the opposite side of the rim. As shown, such means may take the form of a displacer 40 having screw thread operative connection to device 31, as for example to the wedges 33 and 34. The illustrated displacer 40 extends lengthwise transversely through aligned bores 41 in the two wedges and has screw thread 40*a* operative connected to that threading at such bores. That threading connection is differential as respects the two wedges, as for example in turnbuckle relation, whereby, as the displacer is rotated in one rotary direction the wedges are relatively displaced toward one another, to tighten the wedge connections to the drum rim, and as the displacer is rotated in the opposite rotary direction, the wedges are relatively displaced away from one another, to loosen that connection.

Figure 4:
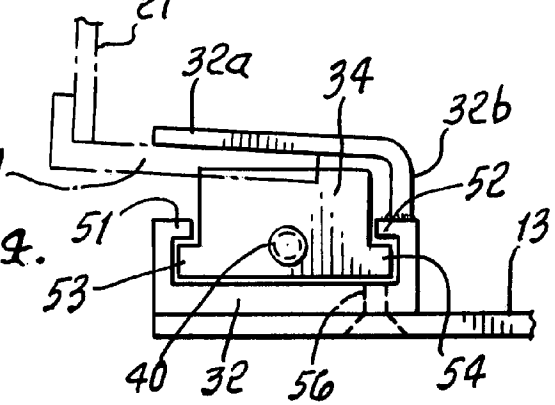
FIG. 4 is an enlarged fragmentary end view taken on lines 4—4 of FIG. 3.
Figure 5:
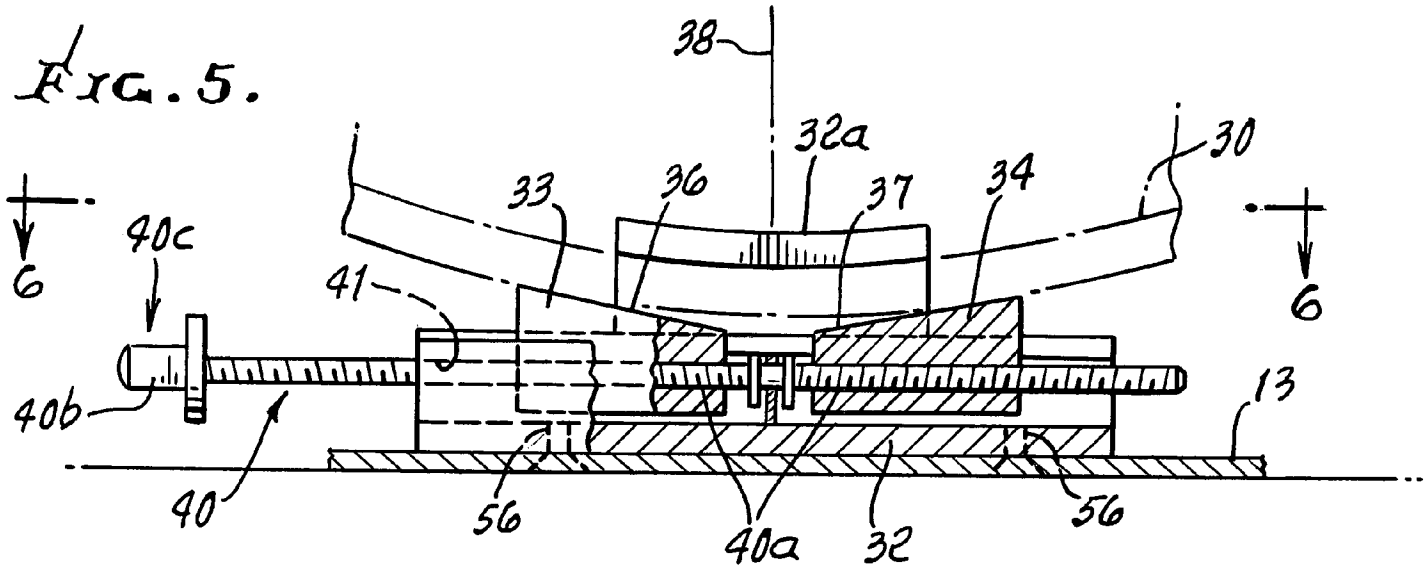
FIG. 5 is an enlarged frontal view taken on lines 5—5 of FIG. 3.
Figure 6:
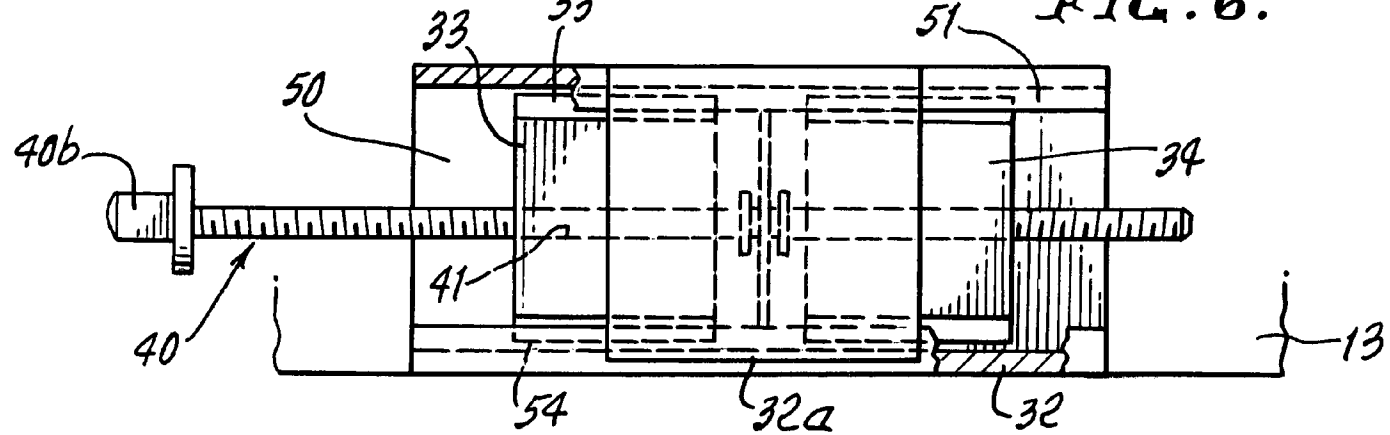
FIG. 6 is a top plan view taken on lines 6—6 of FIG. 5.

Accordingly, as the elongated displacer is rotated in one direction, the drum rim is clamped between the wedges and fixed part 32*a*, and with high mechanical advantage, such as to prevent undesired unclamping of the clamped rim during drum beating impacts, transmitted to the device 10. Part 32*a* is shown in the form of a tongue extending upwardly at 32*b* from the base, and projecting at 32*a* over the drum rim inner side. See FIG. 1. The end 40*c* of the displacer may have wrench flats 40*b* enabling clamping rotary tightening of the displacer by use of a wrench. Wedges 33 and 34 may slide or travel in a channel 50 defined by the base 32. See in FIG. 4, for example channel lips 51 and 52 in FIG. 4, over hanging wedge sideward extensions 53 and 54. A T-slot arrangement is thereby defined.

Base 32 may be attached, as by fasteners 56, to the plate 13 of the drum beater device, for supply at the time of manufacture and sale of the drum beater device; or the clamp device 31 may be separately produced and sold, and it may have other clamping uses, as enabled by fastener attachment to other devices.

Figure 7:
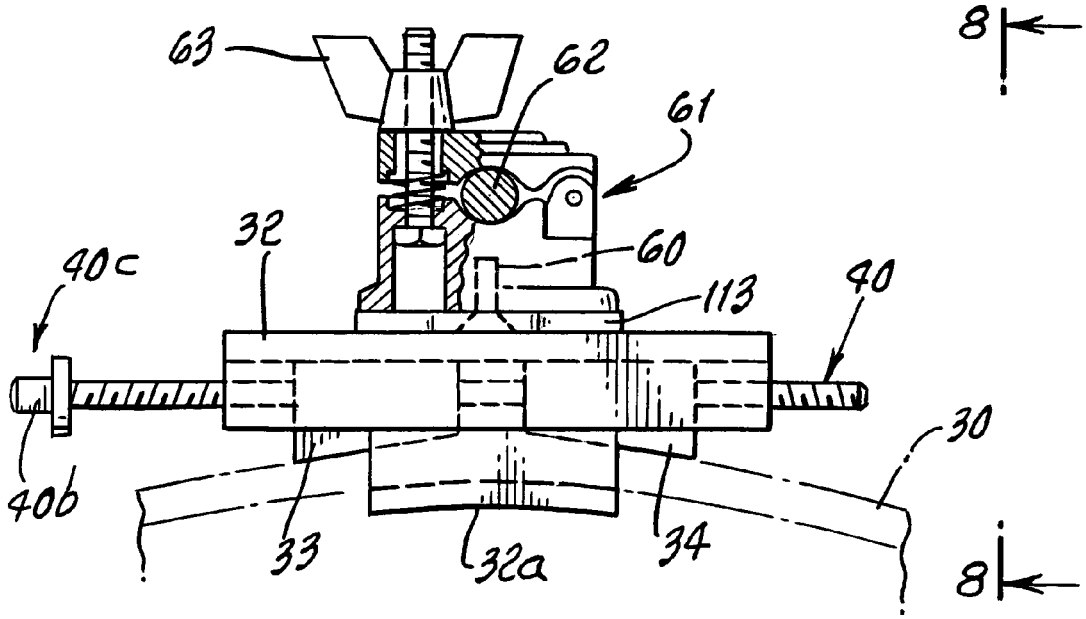
FIG. 7 is a frontal view of a modification, in which the wedge clamping device is employed between a drum hoop and structure including a support rod and an auxiliary clamp.
Figure 8:
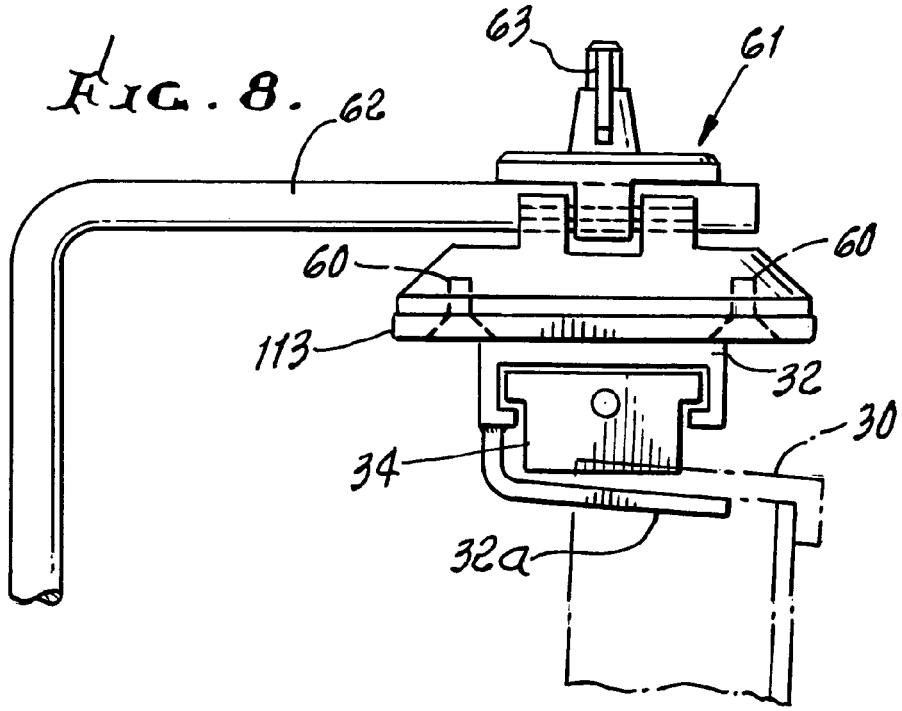
FIG. 8 is an elevation taken on lines 8—8 of FIG. 7.

FIGS. 7 and 8 show fastener 60 attachment of base 32 and plate 113 to an auxiliary clamp structure 61 attached to a rod 62. When wing nut 63 is loosened, clamp structure 61 is loosened and may be adjustably shifted along the rod. The wedges 33 and 34 are shown clamped to a drum rim 30, as before.

Additional advantage include:

The single point hold-down method distorts the bass drum hoop under tension. This distributes uneven amount of pressure applied to the drumhead. Therefore, evenness in tuning is not achieved, resulting in the reduction of vibration (resonance) and degradation of fundamental pitch development of the bass drum sound. Conversely, the 3-point/prism clamp establishes equal contact with minimal pressure placed along the bass drum hoop. The technique alleviates inherent problems in the single point clamping technique allowing accurate tuning of the bass drumhead.

Finally, the 3-point clamping technique offers positive contact between the pedal and the hoop, insuring the pedal or percussion instrument from loosening up due to the extreme forces of rigorous performance.

We claim:

1. A base drum rim clamp device comprising in combination.

a) a base, b) a wedging device to exert clamping force, that device carried by the base, c) means to displace said device to move a surface or surfaces of the device relatively toward one side of a base drum rim, and d) a clamp part to which clamping force is transmitted at the opposite side of the drum rim, e) said device comprising two horizontally separated and angled wedges carried for adjustable relative movement in the same horizontal plane toward one another, or away from one another, f) the base having structure that extends in the horizontal direction of wedge separation and guides such wedge relative movement, g) whereby only three-point clamping support for the drum rim is provided.

2. The combination of claim 1 including the drum rim which is arcuate, and is supported on the wedges, at spaced locations.

3. The combination of claim 1 wherein both wedges are slidably carried for simultaneous relative movement toward one another, or away from one another.

4. The combination of claim 1 wherein said structure defines a channel, along which both wedges are movable.

5. The combination of claim 2 wherein the wedges have substantially flat surfaces that extend in tangential contact relative to the arcuate rim.

6. The combination of claim 1 wherein said means to displace the device includes a displacer having screw thread operative connection to the device.

7. The combination of claim 1 wherein said means to displace the device includes an adjustably rotatable displacer having screw thread operative connection to the wedges.

8. The combination of claim 7 wherein the displacer has differential screw thread operative connection to the wedges, whereby, as the displacer is rotated in one rotary direction the wedges are relatively displaced toward one another, and as the displacer is rotated in the opposite rotary direction, the wedges are relatively displaced away from one another.

9. The combination of claim 8 wherein the wedges have aligned bores which are threaded to receive differential threading on the displacer, whereby both wedges are moved, to clamp the drum rim in response to simple rotation of the displacer in one direction, and with mechanical advantage.

10. The combination of claim 9 wherein the threaded bores and said displacer threading define worm gearing, which prevents unclamping of the rim during drum beating.

11. The combination of claim 1 including a pedal unit having a base plate supporting said base, a pedal pivotally carried by the base plate, a drum beater pivotally carried by the base plate, and a drive connected between the pedal and the drum beater.

* * * * *